US009630689B2

(12) United States Patent
Green et al.

(10) Patent No.: US 9,630,689 B2
(45) **Date of Patent: *Apr. 25, 2017**

(54) WATERCRAFT WITH RETRACTABLE FIN

(71) Applicant: Lifetime Products, Inc., Clearfield, UT (US)

(72) Inventors: Danny Green, Layton, UT (US); Edward G. Van Nimwegen, North Ogden, UT (US); Tim Niemier, Bellingham, WA (US); Joel Bennett, Clinton, UT (US); John Bennett, Clinton, UT (US); Robert Astle, Kaysville, UT (US); Brent Steed, Syracuse, UT (US); Eric Olsen, West Haven, UT (US); Mike Todd, Layton, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 65 days.

This patent is subject to a terminal disclaimer.

(21) Appl. No.: 14/715,340

(22) Filed: May 18, 2015

(65) Prior Publication Data

US 2015/0246712 A1 Sep. 3, 2015

Related U.S. Application Data

(63) Continuation of application No. 13/546,917, filed on Jul. 11, 2012, now Pat. No. 9,067,653.
(Continued)

(51) Int. Cl.

| | |
|---|---|
| ***B63B 35/79*** | (2006.01) |
| ***B63B 13/00*** | (2006.01) |
| ***B63B 35/71*** | (2006.01) |

(52) U.S. Cl.
CPC ..... *B63B 35/7926* (2013.01); *B63B 13/00* (2013.01); *B63B 35/71* (2013.01);
(Continued)

(58) Field of Classification Search
CPC ..... B63B 2035/7903; B63B 35/79; B63B 35/793; B63B 35/7926
See application file for complete search history.

(56) References Cited

U.S. PATENT DOCUMENTS

| | | | |
|---|---|---|---|
| 2,466,006 | A | 4/1949 | Danko |
| 2,593,806 | A | 4/1952 | Steele |

(Continued)

FOREIGN PATENT DOCUMENTS

| | | |
|---|---|---|
| AU | 2012281040 | 3/2015 |
| AU | 2011329284 | 4/2015 |

(Continued)

OTHER PUBLICATIONS

Emotion Kayaks: Traverse; Traverse paddleboard; www.emotionkayaks.com/sup/traverse/Jul. 10, 2012.

*Primary Examiner* — Edwin Swinehart
(74) *Attorney, Agent, or Firm* — Workman Nydegger

(57) ABSTRACT

In one example, a board includes a body having a single piece structure, the body including an upper surface that defines a deck, and a lower surface. The board also includes first and second retractable fins, where the first retractable fin is rotatably connected directly to the body at a first fixed location on the body such that the first retractable fin is rotatable about the first fixed location between an extended position and a retracted position, and the first retractable fin including an engagement portion that is engageable with a first portion of the body and with a second portion of the body. The first retractable fin assumes the extended position when the engagement portion is releasably retained by the
(Continued)

first portion of the body, and the first retractable fin assumes the retracted position when the engagement portion is releasably retained by the second portion of the body.

20 Claims, 12 Drawing Sheets

Related U.S. Application Data

(60) Provisional application No. 61/507,962, filed on Jul. 14, 2011, provisional application No. 61/508,898, filed on Jul. 18, 2011.

(52) U.S. Cl.
CPC ..... *B63B 35/793* (2013.01); *B63B 35/7909* (2013.01); *B63B 35/7906* (2013.01); *B63B 2035/715* (2013.01)

(56) References Cited

U.S. PATENT DOCUMENTS

| | | | |
|---|---|---|---|
| 3,027,575 A | 4/1962 | Fortin | |
| 3,087,173 A | 4/1963 | Meyer | |
| 3,213,822 A | 10/1965 | Sawchuk | |
| 3,803,652 A | 4/1974 | Uyehara | |
| 4,340,376 A | 7/1982 | Williams | |
| 4,608,023 A | 8/1986 | Williams | |
| 4,767,369 A | 8/1988 | Snyder | |
| 4,805,546 A | 2/1989 | Geller et al. | |
| 4,883,436 A | 11/1989 | Oakland | |
| 5,032,096 A | 7/1991 | Scott et al. | |
| 5,127,862 A | 7/1992 | Pia | |
| 5,152,705 A * | 10/1992 | Rock | B63B 35/793 114/130 |
| 5,447,459 A | 9/1995 | Hammond | |
| 5,454,743 A | 10/1995 | Simonson | |
| 5,480,331 A | 1/1996 | Lewis | |
| 5,766,051 A | 6/1998 | Messer | |
| 6,213,044 B1 | 4/2001 | Rodgers et al. | |
| 6,439,940 B1 | 8/2002 | Pouchkarev | |
| 6,623,323 B1 | 9/2003 | Mead | |
| 6,935,909 B2 | 8/2005 | Mann | |
| 2004/0005825 A1 | 1/2004 | Hasted | |
| 2006/0166576 A1 | 7/2006 | Pope | |
| 2009/0081910 A1 | 3/2009 | Starr | |
| 2010/0088955 A1 | 4/2010 | Kania | |

FOREIGN PATENT DOCUMENTS

| | | |
|---|---|---|
| AU | 2012281040 | 8/2015 |
| CA | 2834511 | 3/2015 |
| CN | 201280027397.2 | 6/2015 |
| MX | MX/a/2013/005417 | 5/2015 |
| WO | PCT/US11/60102 | 3/2012 |
| WO | PCT/US12/46521 | 10/2012 |
| WO | PCT/US11/60102 | 5/2013 |
| WO | PCT/US12/46521 | 1/2014 |

* cited by examiner

WATERCRAFT WITH RETRACTABLE FIN

RELATED APPLICATIONS

This patent application is a continuation, and hereby claims the benefit, of: U.S. patent application Ser. No. 13/546,917 filed on Jul. 11, 2012 (issued as U.S.Pat.No. 9,067,653), entitled PADDLEBOARD (the "'917 Application"). The '917 Application, in turn, claims priority to: U.S. Provisional Patent Application Ser. 61/507,962 filed on Jul. 14, 2011, entitled PADDLEBOARD WITH REINFORCING RIB; and, U.S. Provisional Patent Application Ser. 61/508,898 filed on Jul. 18, 2011, entitled PADDLEBOARD. All of the aforementioned applications are incorporated herein in their entirety by this reference.

BACKGROUND OF THE INVENTION

The present invention generally relates to watercraft, such as paddleboards, suitable for use in water sports or other activities. One or more aspects of example embodiments may also find application in water craft such as, but not limited to, kayaks, sailboats, surfboards, paipo boards, boards for wind surfers, knee boards, wakeboards, and body boards, examples of which include boards referred to as boogie boards.

BRIEF SUMMARY OF ASPECTS OF SOME EXAMPLE EMBODIMENTS

Disclosed embodiments are concerned with boards suitable for use in water sports. Example embodiments within the scope of this disclosure may include one or more of the following elements, in any combination: a retractable fin; a retractable fin permanently attached to the board; a retractable fin that rotates or translates between an extended position and a retracted position; a blow-molded feature in the board that securely retains a fin, but also allows the fin to be removed and replaced; relatively deep grooves in the bottom of the board; relatively high rails on the top of the board; a retractable fin connected to a handle or other device accessible by the user to enable the user to move the fin to a desired position when the user is on top of the board; a retractable fin biased into one of an extended position and a retracted position; a retractable fin composed of a material that permits substantial elastic deformation of the fin; a tack-off that includes one or more grip ridges; a board having an upper surface that is at least partly recessed; one or more drain channels; a surface treatment on at least a portion of an upper surface of a board; a handle attached to the board; a drain plug; one or more structures molded as part of the board and configured to aid in the lateral stability of a fin; structures molded as part of the board and configured to enable a fin to be snap-fit, or similarly attached, to the board such that the fin is securely retained in position, but can be removed by a user; and, structure(s) configured to facilitate permanent retention of a retractable fin to a board.

The embodiments disclose herein do not constitute an exhaustive summary of all possible embodiments, nor does this summary constitute an exhaustive list of all aspects of any particular embodiment(s). Rather, this summary simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

Any embodiment of the board that includes a body which is constructed at least partly of blow-molded plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the body, towards a second surface, such as a second interior surface of the body. The ends of one or more depressions may contact or engage the second surface, or the ends of one or more of the depressions may be spaced apart from the second surface by a distance. In some instances, one or more depressions on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depression that contact each other and depressions that are spaced apart from each other may both be present in a board. The depressions may be sized and configured to strengthen and/or reinforce the blow-molded plastic body of the board.

BRIEF DESCRIPTION OF THE DRAWINGS

The appended drawings contain figures of example embodiments to further illustrate and clarify the above and other aspects, advantages and features of the present invention. It will be appreciated that these drawings depict only example embodiments of the invention and are not intended to limit its scope. The invention will be described and explained with additional specificity and detail through the use of the accompanying drawings in which.

DETAILED DESCRIPTION OF EXAMPLE EMBODIMENTS

Embodiments of the invention generally relate to watercraft, such as paddleboards for example, suitable for use in water sports or other activities. One or more aspects of example embodiments may also find application in water craft such as, but not limited to, kayaks, sailboats, surfboards, paipo boards, boards for wind surfers, knee boards, wakeboards, and body boards, examples of which include boards referred to as boogie boards.

A. Aspects of an Example Board

Figure 1:
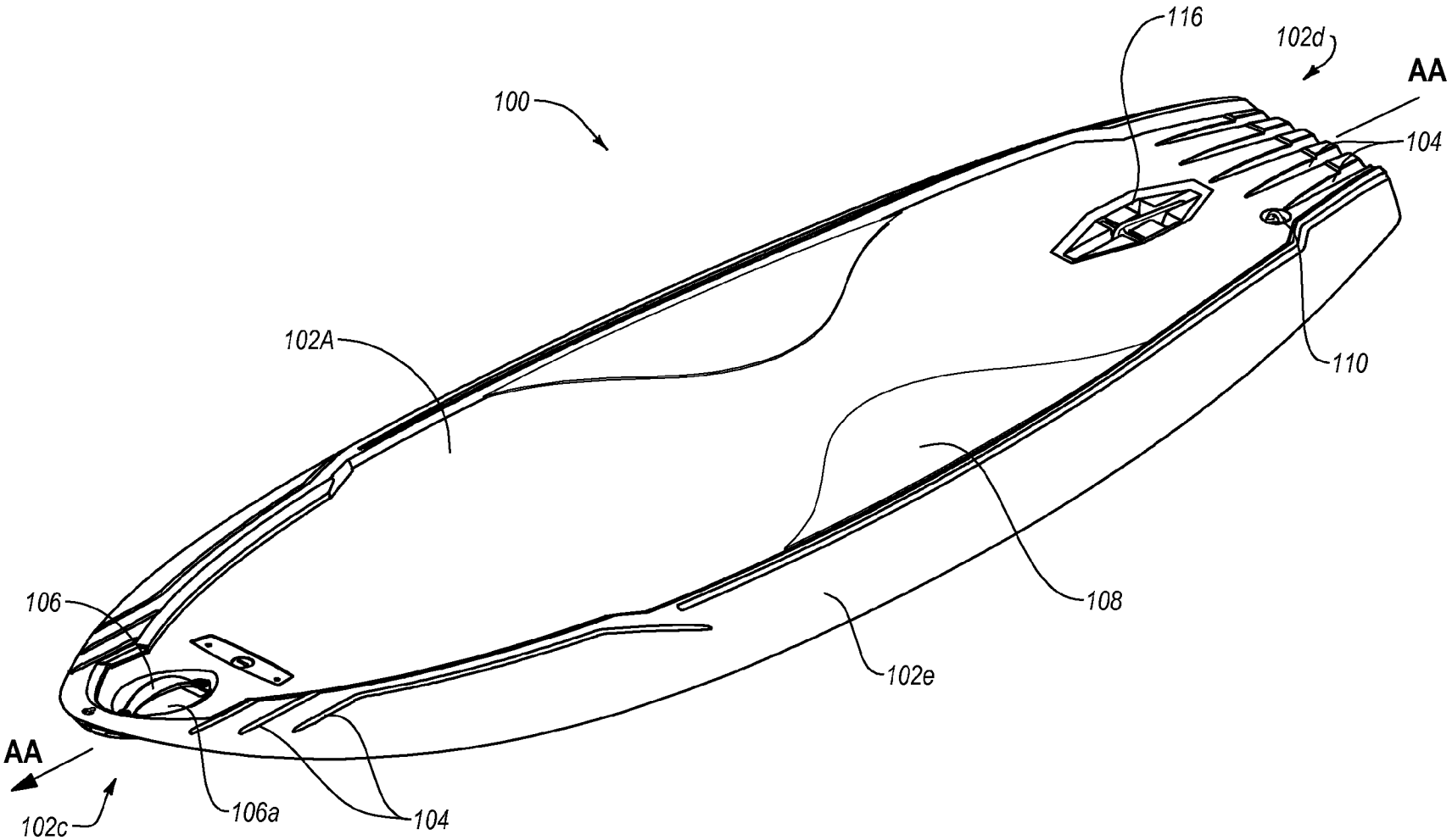
FIG. 1 is a top perspective view of an example board that includes a retractable fin.
Figure 2:
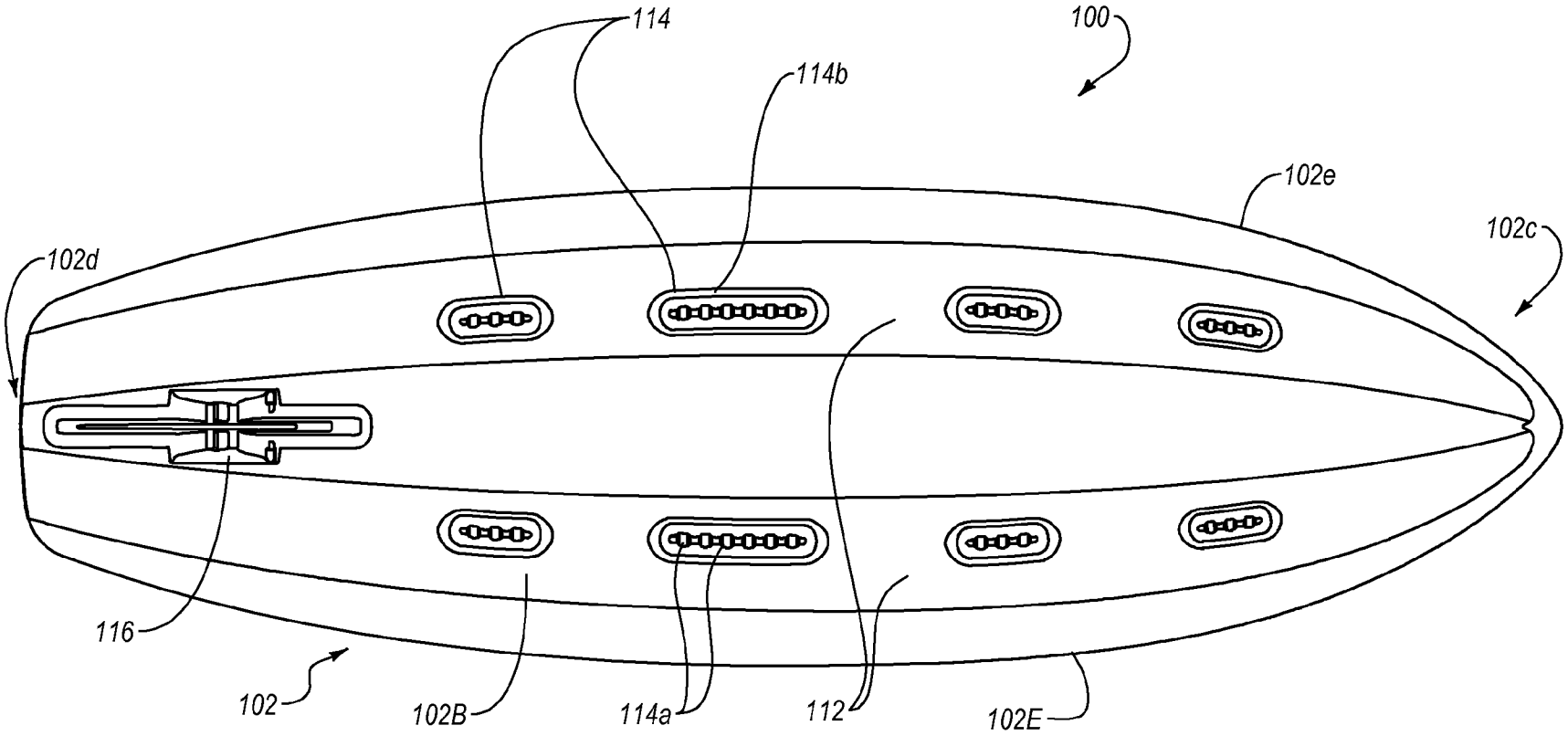
FIG. 2 is a bottom view of an example board that includes a retractable fin.

With particular reference to FIGS. 1 and 2, an example board 100 is disclosed that includes a body 102. Some or all of the body 102 may be constructed of blow-molded plastic that defines an interior that is partially or completely hollow. However, other processes, such as roto-molding, vacuum molding, twin sheet molding, and drape molding, for example, may be employed in the construction of the embodiments disclosed herein, and the scope of this disclosure is not limited to any particular manufacturing process(es).

The body 102 may be any size and/or shape desired, and the Figures provided herewith simply disclose example configurations. In one particular example embodiment, the length of the board 100 may be about 95 inches long, about 28-29 inches wide, and about 4 inches thick. The ratios between length, width and thickness implicit in the foregoing example may be extrapolated to develop dimensions for larger, or smaller, boards while preserving the overall aspects of the board 100. Moreover, yet other embodiments may be relatively thicker, while maintaining approximately the same length and width, or at least the same ratio between length and width. As well, some embodiments may be relatively thicker than the examples above, but only in particular locations such as one or more of the back end of the board 100, and the rails (discussed below). More generally, one or more aspects of the board may be configured as desired to provide a desired level of buoyancy.

Figure 3A:
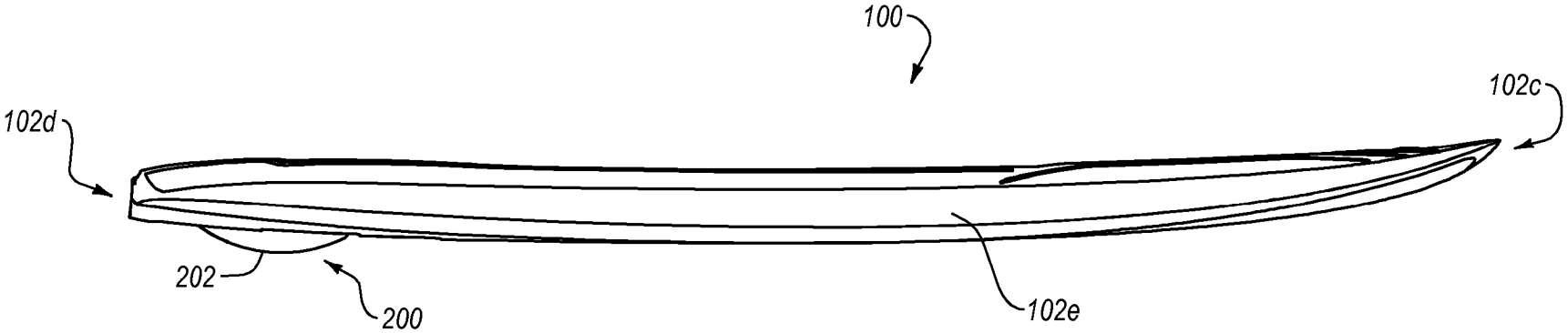
FIG. 3*a* is a side view of an example board that includes a retractable fin, where the fin is shown in a retracted position.
Figure 3B:
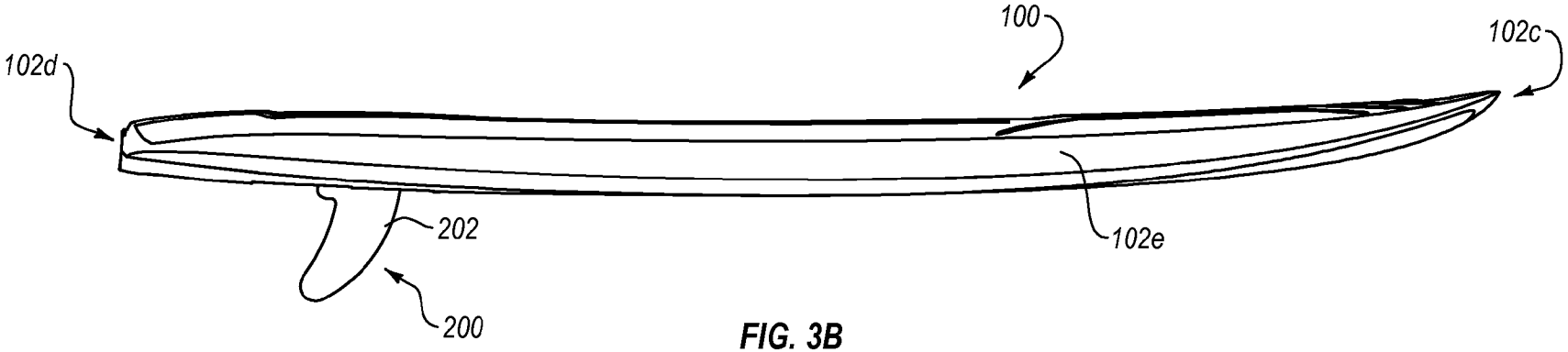
FIG. 3*b* is a side view of an example board that includes a retractable fin, where the fin is shown in an extended position.

In the example of FIGS. 1 and 2, the body 102 is a single piece of blow-molded plastic and includes an upper surface 102A and a lower surface 102*b*. The body 102 may have any suitable shape and configuration. The body 102 may be configured so that the first end 102*c* and/or second end 102*d* are turned up (see, e.g., FIGS. 3*a* and 3*b*, discussed below). In one embodiment, the lower surface 102*b* of the body 102 between the first end 102*c* and second end 102*d* may be substantially flat. The side rails 102*e* of the body 102 may have any desired configuration and, in general, may serve to increase the beam, or width, of the body 102 so that the body 102 is relatively more stable in use. As well, the body 102 may be substantially symmetric about a centerline AA.

Embodiments of the body 102 may include a variety of other elements. For example, the body 102 may include accessories such as a drain channels 104, at the front and/or rear of the upper surface 102*a*, which may help to direct water off the upper surface 102*a* of the body 102. As well, some embodiments of the board 100 may include one or more handles 106 that may be located as desired. In the example of FIG. 1, the board 100 includes a recess 106*a* within which the handle 106 may be at least partially situated. The recess 106*a* may enable a user to better grasp and hold the handle 106.

With particular reference to FIG. 1, at least a portion of the upper surface of some embodiments of the board 100 may be recessed so as to enable the placement of a surface treatment 108 on some or all of the upper surface 102*a*. The recess may help ensure that, when the surface treatment 108 is in place, the surface treatment 108 does not present any lips or edges that could get caught on a user.

The surface treatment 108 can be any suitable material(s). Some suitable materials may: be waterproof, provide a grippy surface for a user so that the user can more readily grasp and hold the board 100, be resistant to absorption/retention of water, be resistant to damage by saltwater, or any combination of the foregoing. Example materials that may be well suited for at least some applications include ethylene-vinyl acetate (EVA) foam decking, acrylonitrile butadiene styrene (ABS) sheeting or other sheeting made of a thermoplastic, polyethylene sheeting, and any combination of the foregoing, disposed on at least a portion of the upper surface 102*a* of the board 100. Other surface treatments, such as texturing for example, may be formed as part of a blow-molding or other manufacturing process. In another example of a surface treatment, the board 100 may include one or more surfaces with a chemically etched textured portion that provides traction and allows for elastomeric sheathing to be adhered. Moreover, any combination of the surface treatments noted herein may be combined in a single board 100.

With continued reference to FIG. 1, embodiments of the board 100 may include one or more drain plugs 110. In general, the drain plug 110 may be threaded or otherwise removably attached to the body 102 so that a user can drain water from the interior of the body 102 by removing the drain plug 110 and orienting the board 100 in such a way that any water in the interior can escape.

With particular reference now to FIG. 2, at least some embodiments of the board 100 include a pair of relatively large longitudinal grooves 112 that extend along a portion of, or substantially all of, a length of the board 100. More, or fewer, than two such grooves 112 may be employed in other embodiments.

The grooves 112 may be relatively wide and/or relatively deep and may enhance the stability and maneuverability of the board 100. Such grooves 112 may each also be sufficiently wide and deep to substantially receive a paddle (not shown) that may be included with the board 100.

As indicated in FIG. 2, the grooves 112 may be configured such that they are relatively wider in a middle portion of the board 100 than at the ends 102*c* and 102*d* of the board 100. For example, the grooves 112 may taper such that they are relatively wider near the middle portion of the board 100 and relatively narrower at one or both of the ends 102*c* and/or 102*d* of the board 100.

The depth of a portion of example grooves 112 is best illustrated in FIGS. 5*a*-6*b*, discussed in more detail below. The depth of the grooves 112 may vary from one location on the lower surface 102*b* to another location on the lower surface 102*b*. For example, the grooves 112 may be relatively deeper near the middle portion of the board 100 and relatively less deep at one or both of the ends 102*c* and/or 102*d* of the board 100.

As best illustrated in FIG. 2, embodiments of the board 100 may include one or more tack-offs 114. In general, one or more tack-offs 114 may be located at any desired location (s) on the upper surface 102*a*, lower surface 102*b*, and/or other portions of the board 100. Correspondingly, the scope of the invention is not limited to any particular size, number, location, configuration, or orientation of tack-offs 114.

In the particular example of FIG. 2, eight tack-offs 114 are provided in the lower surface 102*b*, although more or fewer tack-offs may be employed in the grooves 112 and/or elsewhere. More specifically, four tack-offs 114 are located in each of the grooves 112. However, the grooves 112 need not include any tack-offs 114. As further indicated in FIG. 2, the tack-offs 114 need not all have the same size or configuration. Rather, tack-offs 114 of differing characteristics may be combined in embodiments of the board 100.

Figure 2A:
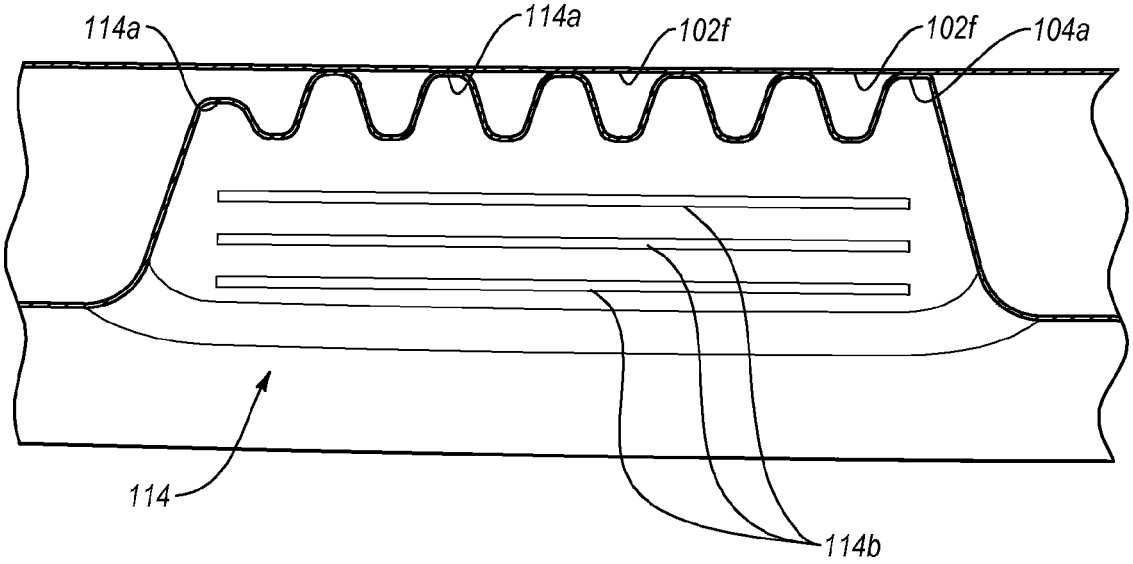
FIG. 2*a* is a partial section view taken from FIG. 2 and disclosing aspects of a tack-off.

Turning now to FIG. 2*a*, embodiments of the invention may include one or more tack-offs 114 that include one or more protrusions 114*a* that extend toward, and may or may not contact an interior surface 102*f* of the body 102 of the board 100. As indicated in FIG. 2*a*, contacting and non-contacting protrusions 114*a* may be combined together in a tack-off. In other cases, a tack-off may include only contacting protrusions, or only non-contacting protrusions.

One of more of the tack-offs 114 may further include one or more grip ridges 114*b* that may be formed as part of a blow-molding, or other, process. The grip ridges 114*b* may be configured and arranged to enable a user to use the tack-off 114 as a handle and to hold the board 100 under his or her arm when carrying it.

In at least some embodiments, and as indicated in FIG. 2*a*, grip ridges 114*b* are included in at least one tack-off 114 on each side of the board 100, so that a user can grasp grip ridges 114*b* regardless of the orientation of the board 100 when the board 100 is being carried under the arm of the user. Inclusion of the grip ridges 114*b* on the lower surface 102*b* of the board 100, as in the example of FIG. 2*a*, may be desirable in some instances because that arrangement contributes to a relatively cleaner configuration and appearance on the upper surface 102*a* of the board 100. However, tack-offs 114 and grip ridges 114*b* may, in some embodiments, be included in the upper surface 102*a*.

Finally, and as disclosed in more detail elsewhere herein (see, e.g., FIGS. 1, 2 and 6*a*-10*b*), the board 100 may include a recess 116 within which one or more fins (discussed below) may be partially, or substantially, received when positioned in a retracted position. The recess 116 may be partly, or completely, formed as part of a blow-molding, or other, process used to form the body 102. Where multiple retractable fins are employed in a board, the board 100 may be configured with a single recess 116 to receive two or more of the retractable fins, or the board may define a respective recess 116 for each retractable fin.

While some embodiments may include a recess that is partly or completely formed as part of a blow-molding process used to form the body 102, methods other than blow-molding may be used to form such a recess. By way of illustration, processes such as drape forming may also be used to form part or all of such a recess. As yet another alternative, an insert that defines a suitable recess for one or more fins may be created by injection molding or other processes. The insert could then be placed into the body of the board and fastened to the board prior to attachment of the fin(s). The insert may be made of plastic and/or any other suitable material(s).

B. General Aspects of Some Example Retractable Fins

With continued reference to FIGS. 1, 2, and 3*a*-10*b*, embodiments of the board 100 may include one or more retractable fins 200. Where multiple retractable fins 200 are employed, they may be evenly spaced apart on opposite sides of the centerline AA (FIG. 1), however, such spacing is not required. As well, if multiple retractable fins 200 are employed, they may be located at the same, or different, longitudinal positions along centerline AA. In the examples disclosed in the Figures, the lateral position of fin 200 is proximate the centerline AA, although the fin 200 need not be so located. In at least some embodiments, the fin 200 and board 100 are configured so that the fin 200 can rotate laterally, that is, toward and away from centerline AA, between an extended and retracted position. Other embodiments, where the fin 200 rotates about an axis that is substantially perpendicular to centerline AA are discussed in detail below.

Figure 4:
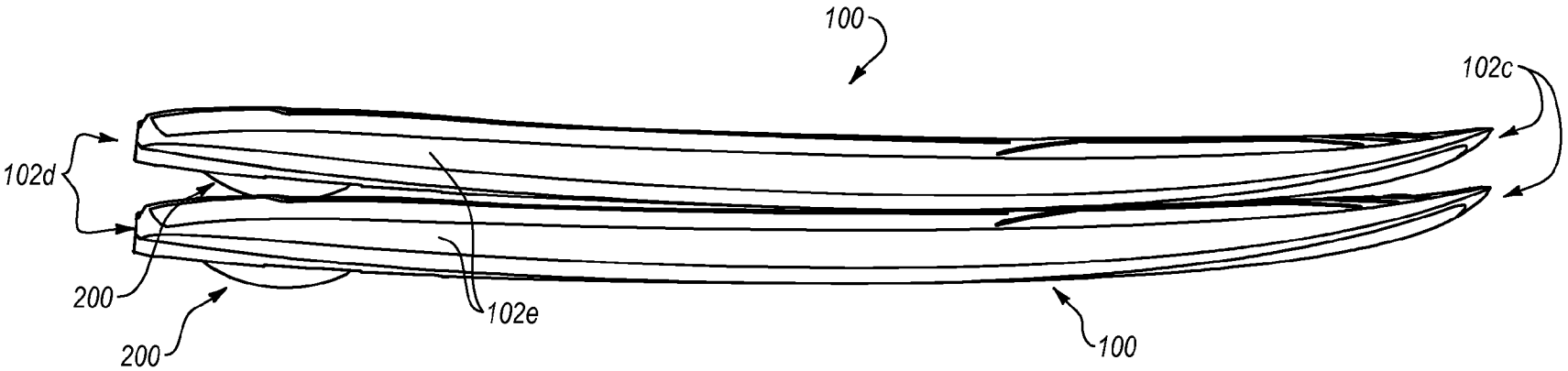
FIG. 4 discloses an arrangement where two boards are stacked one on top of another.
Figure 5A:
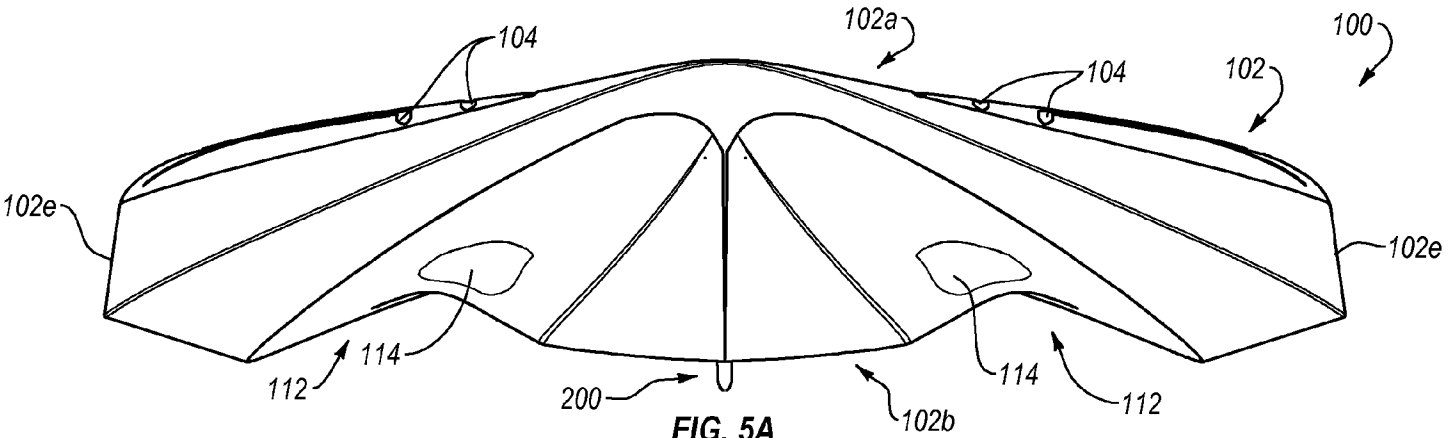
FIG. 5*a* is a front view of an example board that includes a retractable fin, where the fin is shown in a retracted position.
Figure 5B:
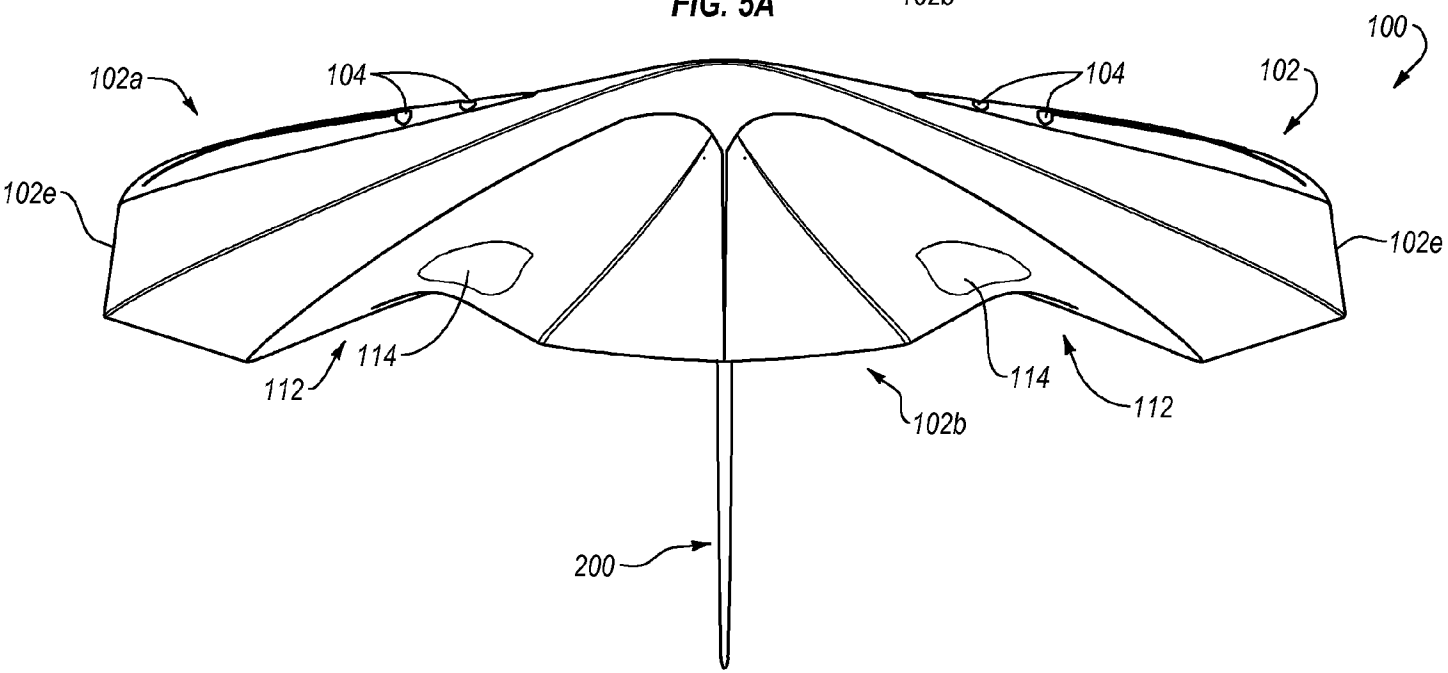
FIG. 5*b* is a front view of an example board that includes a retractable fin, where the fin is shown in an extended position.
Figure 6A:
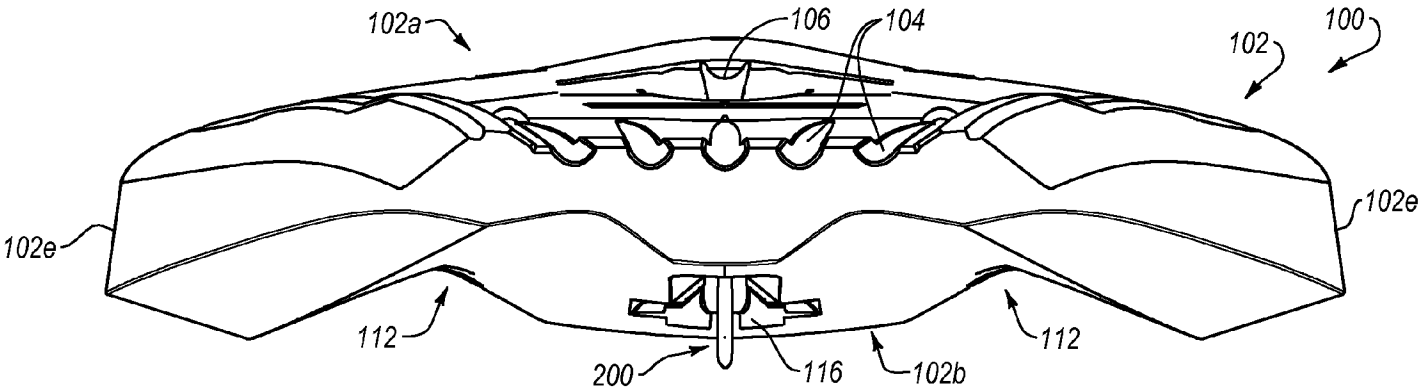
FIG. 6*a* is a front view of an example board that includes a retractable fin, where the fin is shown in a retracted position.
Figure 6B:
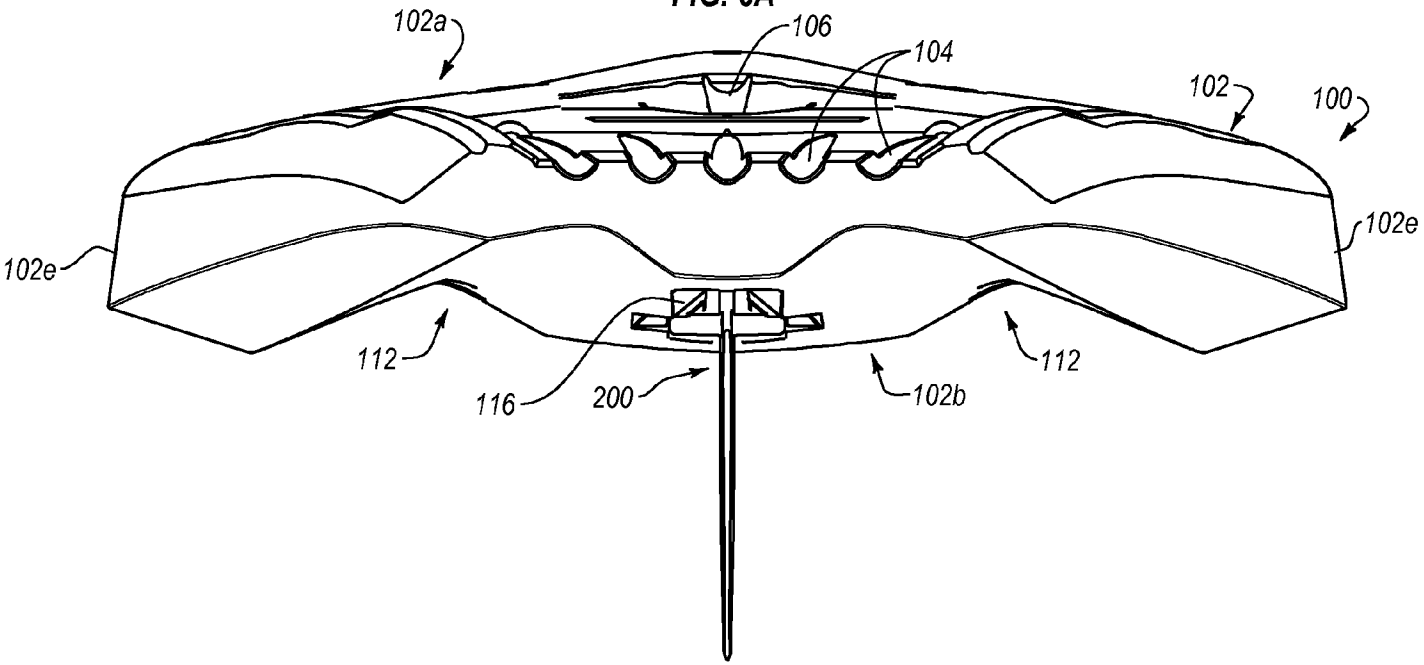
FIG. 6*b* is a front view of an example board that includes a retractable fin, where the fin is shown in an extended position.
Figure 7A:
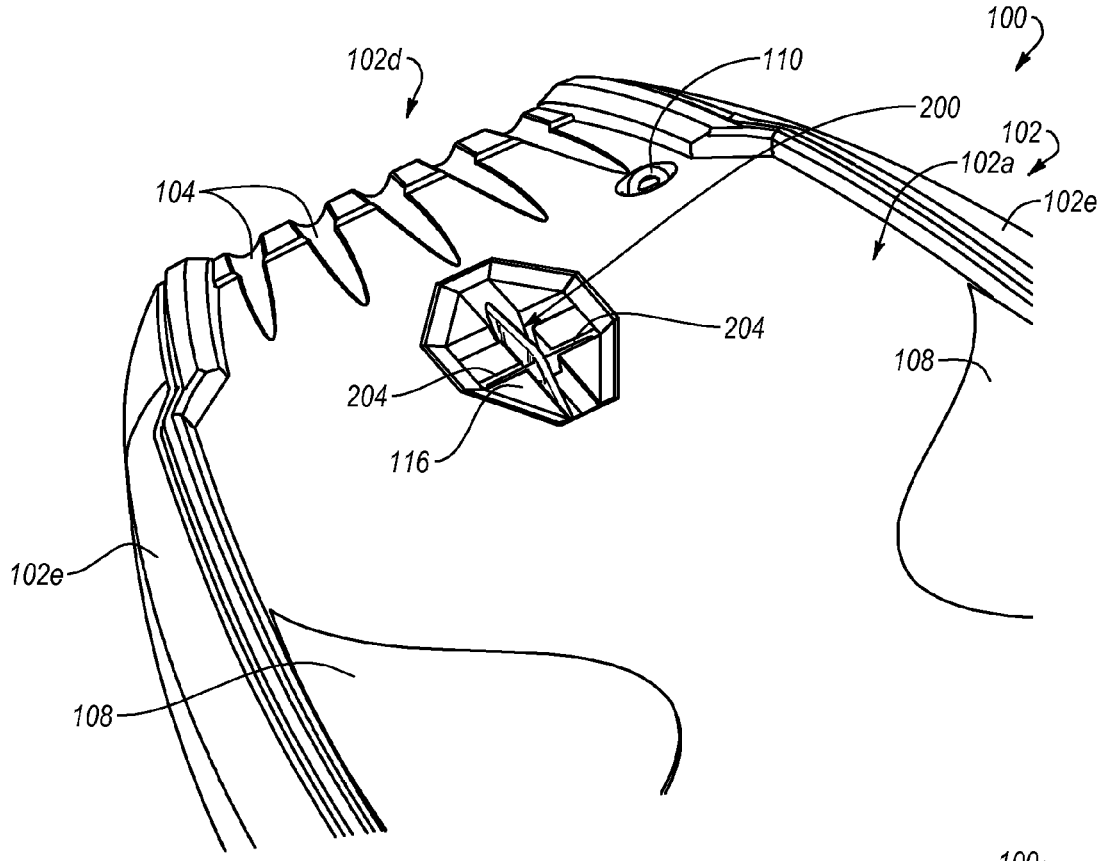
FIG. 7*a* is a partial rear top view of an example board that includes a retractable fin, wherein the fin is shown in a retracted position.
Figure 7B:
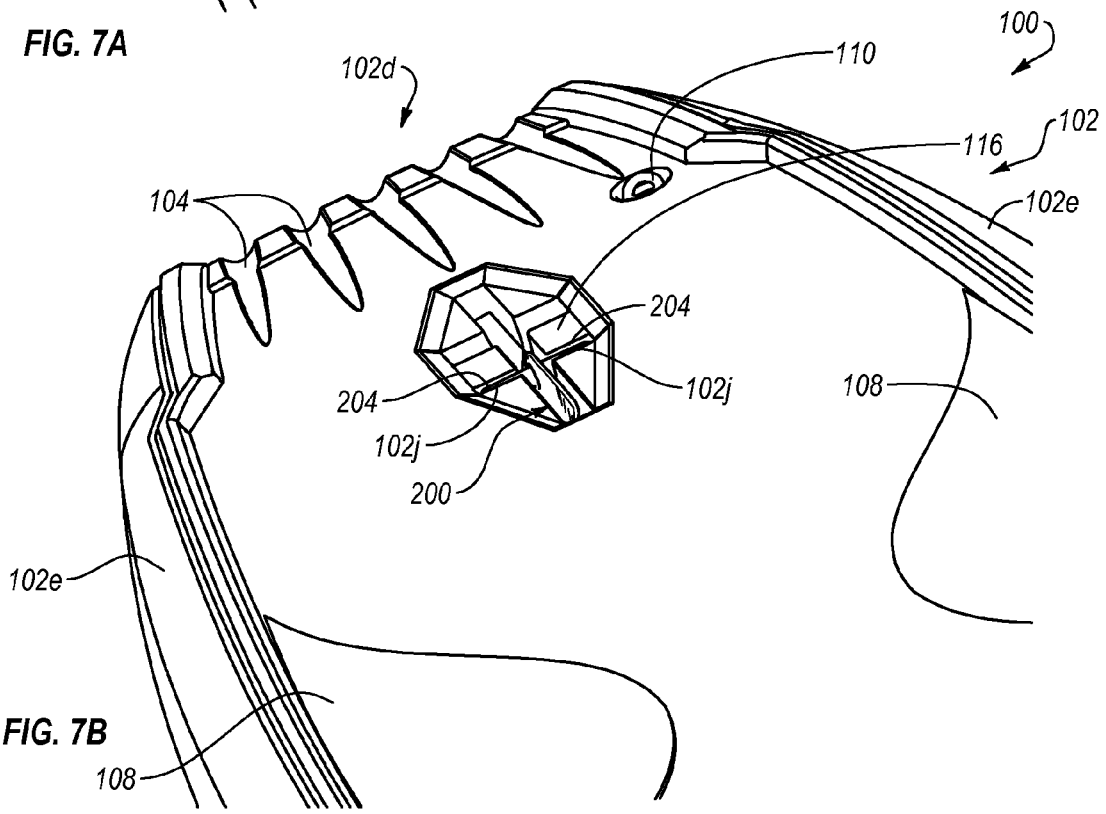
FIG. 7*b* is a partial rear top view of an example board that includes a retractable fin, wherein the fin is shown in an extended position.

As indicated in FIG. 4 in particular, one advantage of at least some embodiments of the fin 200 may be that multiple boards 100 can be stacked one on top of the other, since the fin 200 can be substantially, or completely, retracted into the board to which it is attached so as to allow the boards 100 to be placed in close proximity to each other. This configuration may prove advantageous when transporting multiple boards 100, such as on top of a vehicle, or in a shipping container, since it reduces the amount of space required to transport the boards 100, and/or because it is not necessary to remove the retractable fins 200 from the boards 100 in order to be able to transport the boards 100.

In at least some embodiments, a leading edge 202 (see, e.g., FIG. 3*b*) of the fin 200 may be configured or treated to improve the durability of the fin 200. For example, the material of the leading edge 202 may be relatively thicker than other parts of the fin 200 and/or the leading edge 202 may include one or more of a coating, treatment, or supplemental structures that may improve the durability of the leading edge 202. Such a construction may be beneficial where the leading edge 202 is, or may be, exposed to rocks, sand, or other materials or conditions that could cause premature wear of the leading edge 202. In at least one example embodiment, a shield (not shown) is provided that can be removably attached to the leading edge 202. When the shield begins to show excessive wear, it can be removed and replaced, thus extending the life of the leading edge 202, and of the fin 200.

One or more of the fin(s) 200 may be made of any of a variety of materials including plastics, rubbers, metals, composites, polymers of various types, and combinations of any of the foregoing. In one example embodiment, a fin is made of a polymer that will not break even when the fin is bent significantly, possibly as much as ninety degrees. A fin made of such a polymer may also be elastically deformable, in that it may assume its original shape, or substantially its original shape, even after being significantly bent. This polymer may also be relatively light so that if the fin should become detached from the board, the fin will float and thus be more readily retrievable. One example of a suitable fin material is a mineral filled polypropylene that includes a vinyl flex agent. Other materials with comparable properties may alternatively be employed. Among other things, the flexible material of the fin may allow the fin to bend in situations where it is unable to pivot out of the way of an underwater obstruction.

As well, the fin 200 may take a variety of shapes and sizes, examples of which are indicated in FIGS. 1, 2, and 3*a*-10*b*. In general, the scope of this disclosure embraces any size and shape of fin 200. The size and/or shape of fin 200 may be selected depending upon the intended use of the board 100 and/or conditions expected to be encountered during use of the board 100.

With continued reference to the fin 200 and its relation to the body of a board, such as body 102 for example, some example embodiments may include a leash (not shown) made of a flexible material such as nylon or rubber for example, that may be used to connect the fin 200 to the board 100 so that if the fin 200 should become separated from the board 100 for any reason, the user can readily retrieve the fin 200. Such a leash may be particularly useful if the fin 200 does not float. The leash may be permanently attached to the fin 200 and/or to the board 100. In other embodiments, the leash may be detachably connected to the fin 200 and/or the board 100. In still other embodiments, the leash may be permanently connected to one of the fin 200 or the board 100, and detachably connected to the other of the fin 200 and the board 100. Other mechanisms of comparable functionality to a leash may alternatively be employed.

C. Aspects of Example Retention Mechanisms for a Retractable Fin

With particular reference now to FIGS. 8*a*-10*b*, further details are provided concerning aspects of a configuration and arrangement that enables one or more of retraction, extension, and retention of the fin 200. It should be understood that such a configuration and arrangement is but one example structural implementation of a means for enabling retraction and/or extension of the fin, and any other mechanism(s) of comparable functionality is/are considered to fall within the scope of this disclosure.

Figure 9A:
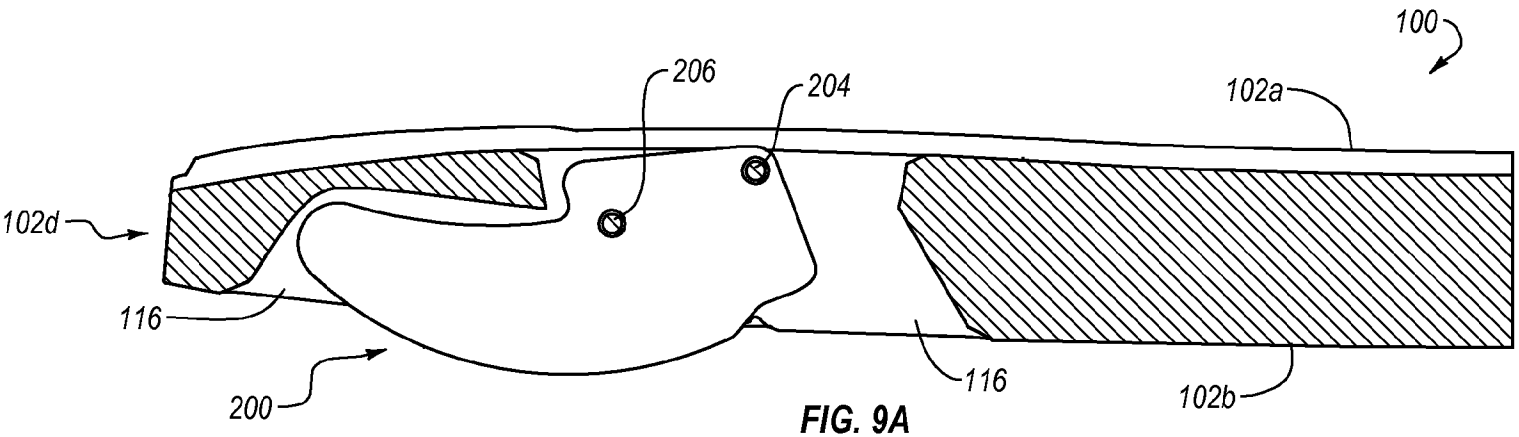
FIG. 9*a* is a section view of an example board that includes a retractable fin, wherein the fin is shown in a retracted position.
Figure 9B:
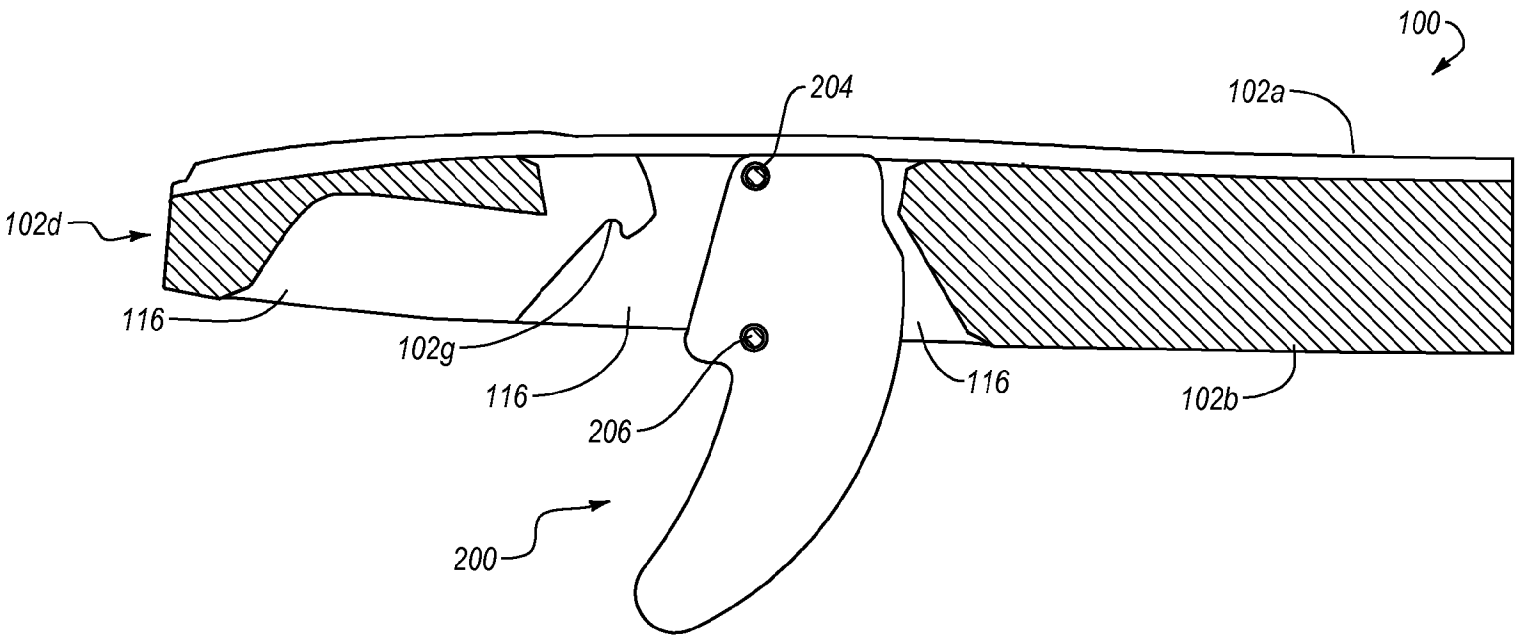
FIG. 9*b* is a section view of an example board that includes a retractable fin, wherein the fin is shown in an extended position.

As best indicated in FIGS. 9*a*-9*b*, the fin 200 may be rotatable, relative to the board 100, about a pin 204. The pin 204 is, in some embodiments, integral with the fin 200. Moreover, the pin 204 may be configured to be snap fit or otherwise securely, but removably, attached to the board 100. For example, the pin 204 may be snap fit into, or otherwise received in, one or more structural elements 102*j* (see FIG. 11), discussed below, which may be implemented as a recess or other suitable configuration.

Such a configuration may enable a user to remove and replace the fin 200 in the event of damage or wear, or in the event the user simply desires to use a fin of a different physical configuration. Thus attached to the board 100, the fin 200 is capable of rotation downward into one or more extended positions (e.g., FIGS. 3*b*, 5*b*, 6*b*, 7*b*, 8*b*, 9*b* and 10*b*), and upward into a retracted position (e.g., FIGS. 3*a*, 4, 5*a*, 6*a*, 7*a*, 8*a*, 9*a* and 10*a*). In at least some embodiments, a plurality of different extended positions are cooperatively defined by the body 102 and the fin 200 such that the extent to which the fin 200 is extended can be 'fine tuned' to suit conditions and/or the desires of a user, and the user is not limited solely to the two fin positions of either extended and retracted.

With continued reference to FIGS. 9*b*-10*b* in particular, the body 102 may define a structural element 102*g*, such as a hook for example, configured to removably receive at least a portion of a corresponding pin 206, such as a pin for example, of the fin 200. The structural element 102*g* may include a ridge, ramp and/or other element(s) over which the pin 206 slips as the pin 206 engages the structural element 102*g*. This ridge or other element may help removably retain the pin 206 in the structural element 102*g*. Additionally, or alternatively, the structural element 102*g* may be configured to be slightly, and temporarily, deformed in response to a force exerted by way of the pin 206, as the pin 206 is disengaged from the structural element 102*g* and/or as the pin 206 is engaged with the structural element 102*g*. In one example implementation, the structural element 102*g* is generally in the form of a hook that defines a curved recess having an opening slightly smaller than the diameter of a pin 206 in the form of a pin, such that exertion of a force is required to engage/disengage the hook and pin. As well, in at least some embodiments, one or more surfaces of the structural element 102*g* and/or pin 206 may be angled, curved or otherwise shaped to facilitate engagement and/or disengagement of those two structural elements.

Figure 8B:
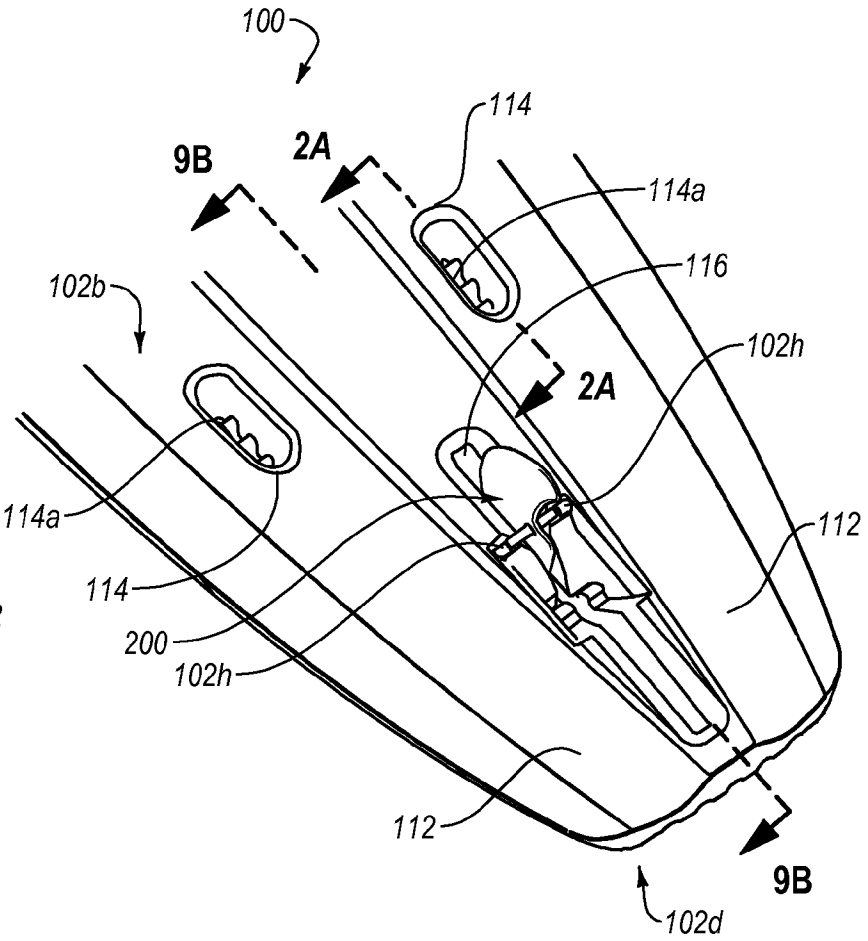
FIG. 8*b* is a partial rear bottom view of an example board that includes a retractable fin, wherein the fin is shown in an extended position.
Figure 8A:
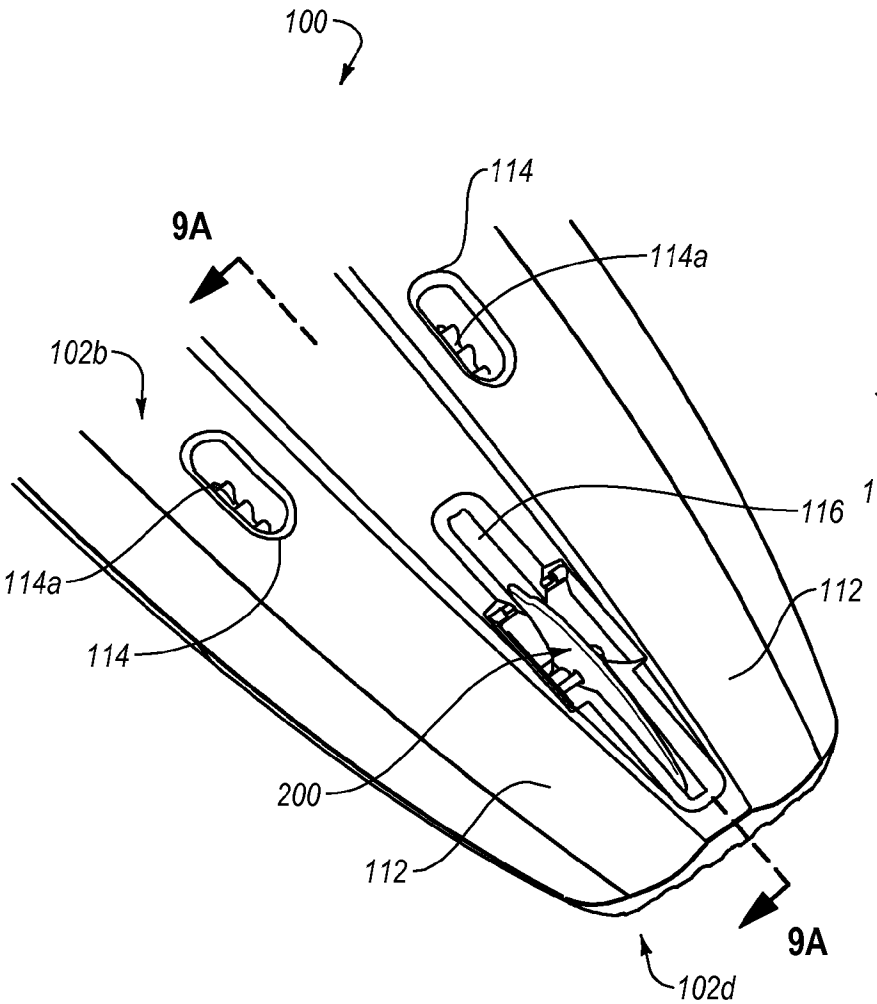
FIG. 8*a* is a partial rear bottom view of an example board that includes a retractable fin, wherein the fin is shown in a retracted position.
Figure 10A:
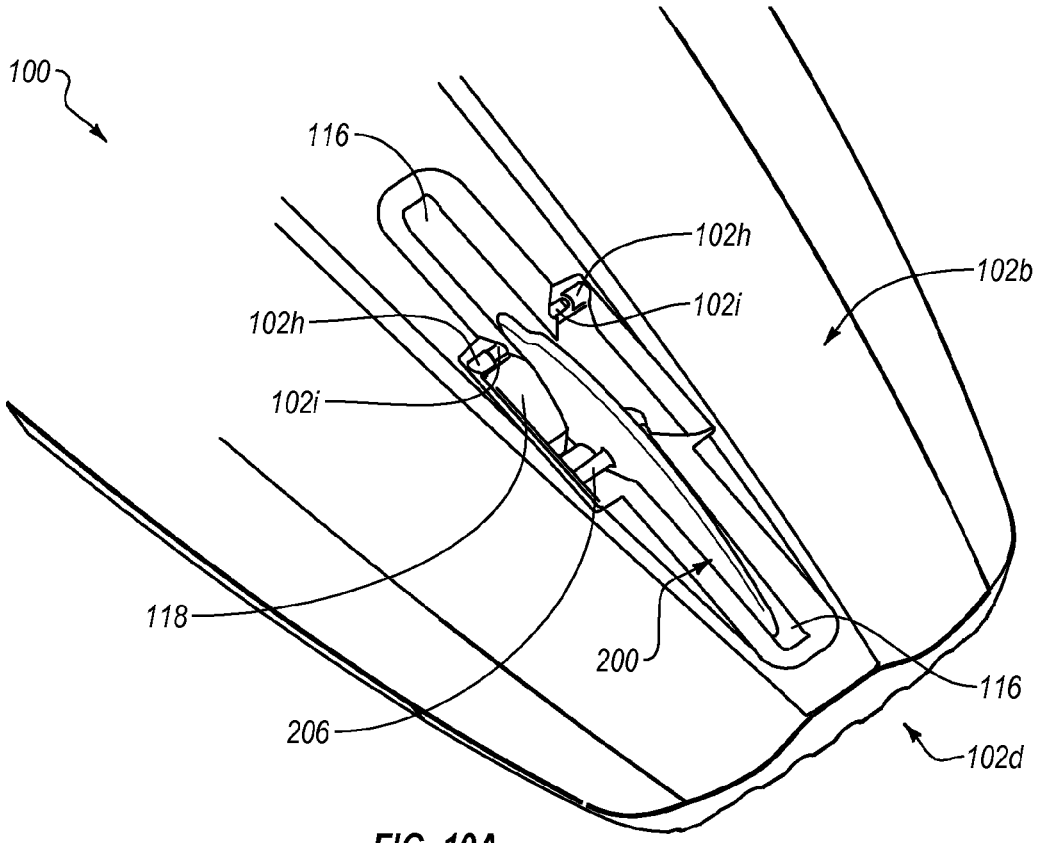
FIG. 10*a* is a partial perspective view of an example fin in a retracted position.
Figure 10B:
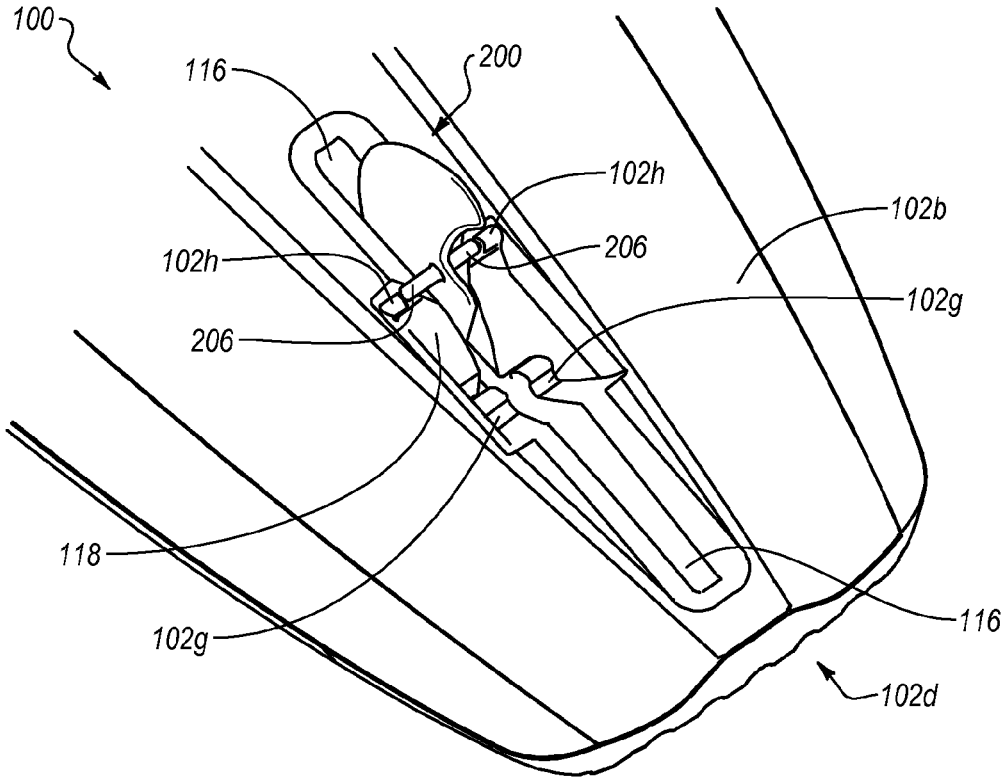
FIG. 10*b* is a partial perspective view of an example fin in an extended position.

With regard now to FIGS. 8*a*, 8*b*, 10*a* and 10*b* in particular, further details are provided concerning some example embodiments. In these figures, the fin 200 is shown in an extended position. As best indicated in FIGS. 8*b* and 10*b*, the body 102 may include structural elements 102*h* that engage the pin 206 of the fin 200 so as to provide a degree of lateral stability. In at least one embodiment, the structural elements 102*h* are integrally molded as part of the body and are configured to enable the fin 200 to be snap fit, or otherwise securely but removably attached, to the body 102 as disclosed in more detail elsewhere herein. The structural elements 102*h* are one example structural implementation of a means for providing lateral stability to the fin 200. Any other structure(s) of comparable functionality may likewise be employed however, and the scope of this disclosure is not limited to the structural elements 102*h*. As well, the structural elements 102*h* may, in some embodiments, be discrete elements separate from, but attached to, the body 102.

With continued reference to FIGS. 8*a*, 8*b*, 10*a* and 10*b* in particular, some example embodiments further include one or more structural elements 102*i* each configured to releasably receive a portion of pin 206, in a manner that may be similar to the way in which the structural element 102*g* receives a portion of pin 206. Thus, the structural elements 102*i* may be similar, or identical, in configuration to the structural elements 102*g*. Thus configured and arranged, the structural elements 102*i* and 102*g* may cooperatively define a range of motion of the pin 206 and, accordingly, the fin 200.

In terms of their construction, the structural elements 102*i* and/or 102*g* may be integrally molded or otherwise formed as part of the body 102 or, alternatively, may comprise portions of a separately formed piece that is fitted into a recess defined by the body 102. Other constructions of the structural elements 102*i* and 102*g* may alternatively be employed. Similarly, structural elements 102*j* that engage pins 204 may be constructed with a similar, or identical, configuration to that of the structural elements 102*i* and/or 102*g*.

As indicated in FIGS. 10*a* and 10*b*, some embodiments of the board 100 may include one or more guide elements 118 positioned between a structural element 102*i* and 102*g* so that the pin 206 moves along, and may contact in some instances, the guide element 118. In general, the guide element 118 may serve to guide and support the pin 206 as it moves between structural element 102*i* and 102*g*. The guide element 118 may be implemented as, or include, a curved surface. Like the structural elements 102*i* and 102*g*, the guide elements 118 may be integrally molded or otherwise formed as part of the body 102 or, alternatively, may comprise portions of a separately formed piece that is fitted into a recess defined by the body 102. Other constructions of the guide elements 118 may alternatively be employed.

D. Further Aspects of Some Example Embodiments

In at least some embodiments, a board may include one or more retractable fins that are permanently attached to the board. This configuration may be effected in any number of ways.

Figure 11:
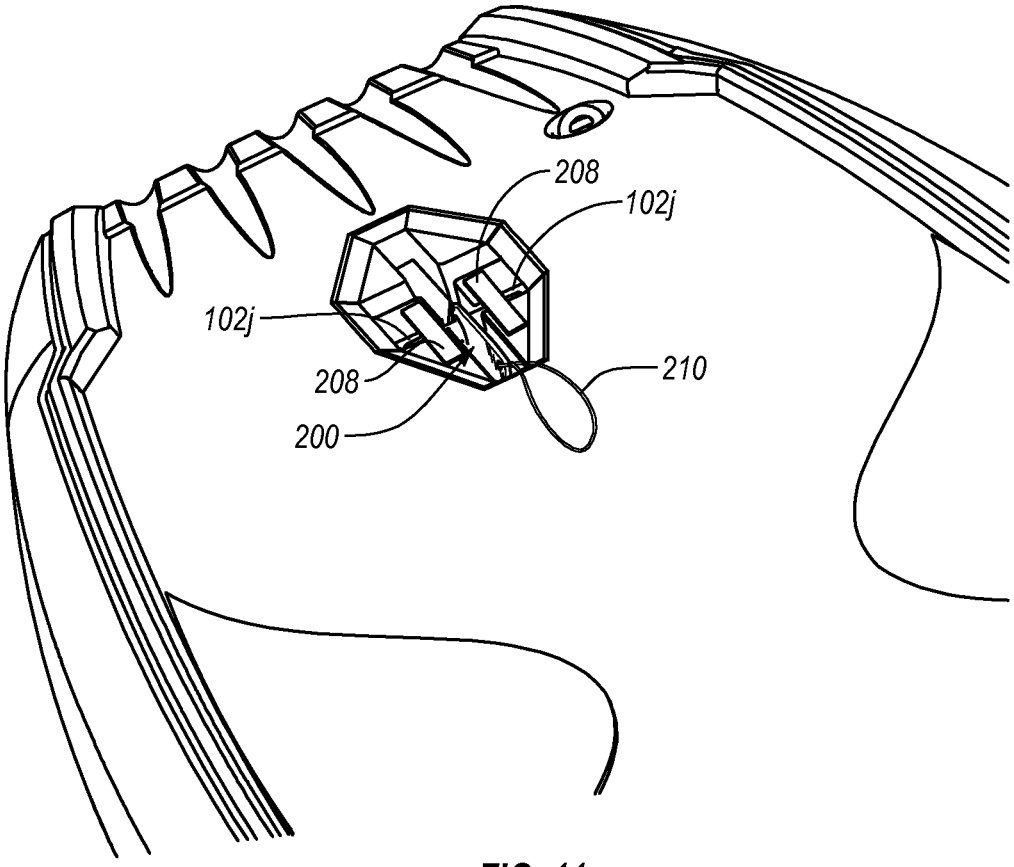
FIG. 11 is a partial perspective view of an example board that includes a retractable fin.

One example of such a permanent attachment of the retractable fin to the board is disclosed in FIG. 11. As indicated in FIG. 11, two retainers 208 are provided that are arranged parallel to, and on either side of, the retractable fin 200, and longitudinally with respect to the board 100. Each retainer 208 serves to confine a respective pin 204 of the retractable fin 200 in a structural element 102*j*, such as a recess, so that the retractable fin is permanently retained in the recess, while still being free to rotate relative to the recess. The retainers 208 may be riveted, glued, or otherwise attached to the board 100. In some instances, the retainers 208 may be secured to the board using removable fasteners, such as screws for example. As is apparent from the foregoing, the retainers 208 are an example of a structural implementation of a means for permanently attaching the retractable fin to the board. However, any other structural device(s) of comparable functionality may be employed in place of the retainers 208 and are considered as being within the scope of this disclosure.

As suggested in the figures, some embodiments are configured so that the retractable fin 200 may be accessible from the top of the board so that the user can easily position the fin as desired. With continued attention to FIG. 11, some embodiments may accordingly include a handle 210 accessible from the top of the board by a user so that the user can change the position of the retractable fin 200 to which the handle 210 is attached.

As well, embodiments of the board, such as the examples disclosed herein, may include one or more biasing elements, such as a spring for example, that serve to bias the fin to a retracted and/or extended position. The spring may be a separate element, such as a metal spring for example, or may be formed integrally as a part of the board.

As well, embodiments of the board may include a locking device, such as a pushbutton lock for example, that enables a user to lock the fin in one or more desired positions, such as an extended and/or retracted position for example. Alternatively, a switch or lever may be provided that is connected directly or indirectly to the fin and that enables a user to lock the fin in one or more desired positions, such as an extended and/or retracted position for example.

Although this disclosure has been described in terms of certain embodiments, other embodiments apparent to those of ordinary skill in the art are also within the scope of this disclosure. Accordingly, the scope of the disclosure is intended to be defined only by the claims which follow.

What is claimed is:

1. A board suitable for use in water sports and comprising:

a body in the form of a single piece structure, the body including an upper surface and a lower surface, the upper surface defining a deck;

a first retractable fin rotatably connected directly to the body at a first fixed location on the body such that the first retractable fin is rotatable about the first fixed location between an extended position and a retracted position, and the first retractable fin including an engagement portion that is engageable with a first portion of the body and with a second portion of the body, wherein the first retractable fin assumes the extended position when the engagement portion is releasably retained by the first portion of the body, and the first retractable fin assumes the retracted position when the engagement portion is releasably retained by the second portion of the body; and a second retractable fin rotatably connected to the body.

2. The board as recited in claim 1, wherein the body defines a first recess within which the first retractable fin is partly disposed, and the body defines a second recess within which the second retractable fin is partly disposed.

3. The board as recited in claim 1, wherein the first retractable fin and the second retractable fin are disposed on opposite respective sides of a longitudinal centerline defined by the body.

4. The board as recited in claim 1, wherein a position of one of the first and second retractable fins is adjustable by a user from the upper surface of the body.

5. The board as recited in claim 1, wherein the body is a hollow plastic structure.

6. The board as recited in claim 1, wherein the lower surface of the body defines first and second longitudinal grooves that extend along a portion of a length of the board.

7. The board as recited in claim 1, wherein one of the retractable fins is permanently attached to the body.

8. The board as recited in claim 1, wherein the first retractable fin is configured and arranged for snap-fit engagement with the first and second portions of the body.

9. The board as recited in claim 1, wherein the body includes a structure that limits lateral movement of the first retractable fin.

10. The board as recited in claim 1, wherein the second retractable fin is connected directly to the body at a second fixed location on the body such that the second retractable fin is rotatable about the second fixed location between an extended position and a retracted position, and the second retractable fin including an engagement portion that is engageable with a third portion of the body and with a fourth portion of the body, wherein the second retractable fin assumes the extended position of the second retractable fin when the engagement portion of the second retractable fin is releasably retained by the third portion of the body, and the second retractable fin assumes the retracted position of the second retractable fin when the engagement portion of the second retractable fin is releasably retained by the fourth portion of the body.

11. The board as recited in claim 1, wherein the engagement portion of the first retractable fin comprises a pair of pins that cooperate with corresponding structure of the hollow plastic body to:

releasably retain the first retractable fin in the extended position; and releasably retain the first retractable fin in the retracted position.

12. The board as recited in claim 1, further comprising first and second upwardly extending longitudinal side rails disposed proximate respective sides of the board.

13. A kayak comprising:

a buoyant body in the form of a single piece structure sized and configured to support the weight of a user; and a retractable fin rotatably connected directly to the body at a fixed location on the body such that the retractable fin is rotatable about the fixed location between an extended position and a retracted position, and the retractable fin including an engagement portion that is engageable with a first portion of the body and with a second portion of the body, wherein the retractable fin assumes the extended position when the engagement portion is releasably retained by the first portion of the body, and the retractable fin assumes the retracted position when the engagement portion is releasably retained by the second portion of the body.

14. The kayak as recited in claim 13, wherein the engagement portion of the retractable fin comprises a pair of pins that cooperate with corresponding structure of the buoyant body to:

releasably retain the retractable fin in the extended position; and releasably retain the retractable fin in the retracted position.

15. The kayak as recited in claim 13, wherein the buoyant body includes an integral element that cooperates with the engagement portion of the retractable fin to aid in releasable retention of the retractable fin in a desired position.

16. The kayak as recited in claim 13, further comprising a plurality of tack-offs integral with the buoyant body.

17. The kayak as recited in claim 13, wherein the buoyant body is a hollow plastic structure.

18. A paddleboard, comprising:

a hollow plastic body in the form of a single piece structure, the body including an upper surface and a lower surface, the upper surface defining a deck;

first and second upwardly extending longitudinal side rails integral with the body and disposed proximate respective sides of the paddleboard;

first and second longitudinal grooves defined in the lower surface of the body and extending along a majority of a length of the paddleboard; and a retractable fin located in a rear portion of the paddleboard and rotatably connected directly to the body at a fixed location on the body such that the retractable fin is rotatable about the fixed location between an extended position and a retracted position, and the retractable fin including an engagement portion that is engageable with a first portion of the body and with a second portion of the body, wherein the retractable fin assumes the extended position when the engagement portion is releasably retained by the first portion of the body, and the retractable fin assumes the retracted position when the engagement portion is releasably retained by the second portion of the body.

19. The paddleboard as recited in claim 18, wherein a portion of the deck is recessed and covered with a deck covering.

20. The paddleboard as recited in claim 18, wherein the first and second portions of the body are each engageable with the engagement portion of the retractable fin in a snap-fit relation.

* * * * *